US009429067B2

(12) United States Patent
Yamada et al.

(10) Patent No.: US 9,429,067 B2
(45) Date of Patent: Aug. 30, 2016

(54) TWO-STROKE ENGINE WITH VARIABLE SCAVENGING PORT

(71) Applicant: HONDA MOTOR CO., LTD., Tokyo (JP)

(72) Inventors: Yoshikazu Yamada, Saitama (JP); Mashu Kurata, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 84 days.

(21) Appl. No.: 14/514,572

(22) Filed: Oct. 15, 2014

(65) Prior Publication Data

US 2015/0184579 A1 Jul. 2, 2015

(30) Foreign Application Priority Data

Dec. 26, 2013 (JP) ..... 2013-269845

(51) Int. Cl.

| | |
|---|---|
| ***F02B 25/08*** | (2006.01) |
| ***F02B 25/04*** | (2006.01) |
| ***F02B 75/02*** | (2006.01) |
| ***F02F 7/00*** | (2006.01) |
| ***F02B 33/30*** | (2006.01) |
| *F02B 75/32* | (2006.01) |

(52) U.S. Cl.

CPC ..... *F02B 25/04* (2013.01); *F02B 33/30* (2013.01); *F02B 75/02* (2013.01); *F02F 7/0036* (2013.01); *F02B 75/32* (2013.01); *F02B 2075/025* (2013.01)

(58) Field of Classification Search

CPC .. F02B 25/04; F02B 25/06; F02B 2075/025; F02B 33/30; F02B 75/32; F02F 7/0036

USPC ..... 123/65 P

See application file for complete search history.

(56) References Cited

U.S. PATENT DOCUMENTS

| | | | | |
|---|---|---|---|---|
| 5,000,133 | A * | 3/1991 | Kawamura | 123/65 VC |
| 5,072,699 | A * | 12/1991 | Pien | 123/65 VC |
| 7,017,535 | B2 * | 3/2006 | Araki et al. | 123/65 A |

FOREIGN PATENT DOCUMENTS

| | | | |
|---|---|---|---|
| EP | 1 471 228 | A2 | 10/2004 |
| JP | 63-183323 | U | 11/1988 |
| JP | H05-280321 | A | 10/1993 |
| JP | H06-159068 | A | 6/1994 |
| JP | 7-324626 | A | 12/1995 |
| JP | 2009-115099 | A | 5/2009 |

OTHER PUBLICATIONS

Office Action dated Jun. 14, 2016, issued in counterpart to Japanese Patent Application No. 2013-269845, with English translation. (7 pages).

* cited by examiner

*Primary Examiner* — Marguerite McMahon

(74) *Attorney, Agent, or Firm* — Westerman, Hattori, Daniels & Adrian, LLP

(57) ABSTRACT

Provided is a two stroke engine that can vary the timing of opening and closing the scavenging port (43) by using a highly simple structure. An end of the scavenging port (43) on the side of the combustion chamber (44) is defined by scavenging orifices (42*c*) formed in a cylinder sleeve (42), and a shutter (73, 74) is provided on the cylinder sleeve so as to selectively project into the scavenging orifices (42*c*) from an upper edge (42*d*) thereof by moving along an axial line (3X) of the cylinder bore (3*a*).

4 Claims, 6 Drawing Sheets

TWO-STROKE ENGINE WITH VARIABLE SCAVENGING PORT

TECHNICAL FIELD

The present invention relates to a two-stroke engine, and in particular to a technology for varying the timing of opening and closing a scavenging port.

BACKGROUND OF THE INVENTION

A two-stroke engine typically includes a scavenging port that communicates with the crank chamber and opens out at a side wall of the cylinder bore so that a mixture containing fuel is supplied from the crank chamber to the cylinder bore via the scavenging port, and this flow displaces or scavenges the combustion gas remaining in the cylinder out of the combustion chamber at the same time. The scavenging port is opened and closed depending on the position of the piston that reciprocates in the cylinder bore such that the scavenging port communicates with the combustion chamber defined above the piston when the piston is near the bottom dead center, and is shut off from the combustion chamber when the piston is away from the bottom dead center.

In such a two-stroke engine, it is known to provide a flow guide such as louver fins adjacent to the scavenging openings at the cylinder bore wall in order to create a circumferential component in the scavenging flow. The circumferential component may also be varied by changing the angle of the flow guide. See JP63-183323U. By thus directing the scavenging flow in the circumferential direction, a swirl flow of the mixture is created in the cylinder bore.

However, this prior proposal is not configured to change the timing of opening and closing the scavenging port. If the timing of opening and closing the scavenging port can be varied, the volume of the mixture that is supplied to the combustion chamber and the amount of the internal EGR can be varied depending on the operating condition so that the output and efficiency properties of the engine can be improved over a wide operating range.

SUMMARY OF THE INVENTION

In view of such problems of the prior art, a primary object of the present invention is to provide a two stroke engine that can vary the timing of opening and closing the scavenging port by using a highly simple structure.

To achieve such an object, the present invention provides a two-stroke engine including a piston slidably received in a cylinder bore defined in a cylinder block, a combustion chamber being defined by the cylinder bore and the piston, comprising: a scavenging port having an open end opening out at a part of a cylinder wall defining a side of the cylinder bore, the open end communicating with the combustion chamber when the piston is near a bottom dead center thereof; and a shutter provided on the cylinder wall so as to selectively project into the open end from an upper edge thereof by moving along an axial line of the cylinder bore.

By thus changing the effective position of the upper edge of the opening of the scavenging port by using the shutter, the opening and closing timing of the scavenging port can be changed.

Typically, the shutter comprises a tubular portion disposed so as to be axially moveable in a coaxial relationship with the cylinder bore.

Thereby, even when the scavenging port is provided with a plurality of individual open ends on the side of the cylinder bore, the single tubular portion can open and close all of the open ends at the same time. Also, guiding the tubular member in parallel orientation with the cylinder axial line can be simplified, as compared with a plate member provided for each individual open end. Therefore, the timing of opening and closing each open end can be precisely controlled in a stable manner.

According to a preferred embodiment of the present invention, the cylinder bore is defined by a cylinder sleeve, and the open end of the scavenging port comprises a scavenging orifice passed across a thickness of the cylinder sleeve, the tubular portion being wrapped around the cylinder sleeve in an axially slidable manner.

Thereby, the mounting of the tubular portion on the cylinder bore and the guiding of the tubular portion along the cylinder axial line are facilitated.

According to a certain aspect of the present invention, a part of the cylinder block surrounding the scavenging port is provided with a recess defining a passage leading to the scavenging orifice.

Thereby, the scavenging port can be formed by using a highly simple structure.

According to a particularly preferred embodiment of the present invention, an annular recess is formed on a part of an outer circumferential surface of the cylinder sleeve provided with the scavenging orifice, and the tubular portion closely surrounds a bottom surface of the annular recess in an axially slidable manner.

Thereby, the upper limit and the lower limit of the movement of the tubular portion along the cylinder axial line can be defined by the upper and lower edges (walls) of the annular recess without requiring any additional stopper members.

According to a certain embodiment of the present invention, the tubular portion includes a projection received in the scavenging orifice and defining the cylinder bore jointly with the inner circumferential surface of the cylinder sleeve.

Thereby, when the tubular portion is closing a part of each scavenging orifice, substantially no gap is created between the piston (or the compression ring thereof) and the inner wall of the cylinder bore so that the scavenging port can be closed without any significant leakage when the piston is in a position to close the scavenging orifice, and the opening and closing timing of the scavenging port can be determined in a precise manner.

The shutter can be actuated by using any per se means. For instance, the shutter may further include a rack extending axially on an outer surface of the tubular portion, and a pinion rotatably supported by the cylinder block and meshing with the rack. The pinion may be turned by using an electric motor which is controlled by an electronic control unit according to the operating condition of the engine.

BRIEF DESCRIPTION OF THE DRAWINGS

Now the present invention is described in the following with reference to the appended drawings, in which.

DESCRIPTION OF THE PREFERRED EMBODIMENT(S)

The present invention is described in the following with respect to a uni-flow type, single cylinder, two-stroke engine (engine E).

Figure 1:
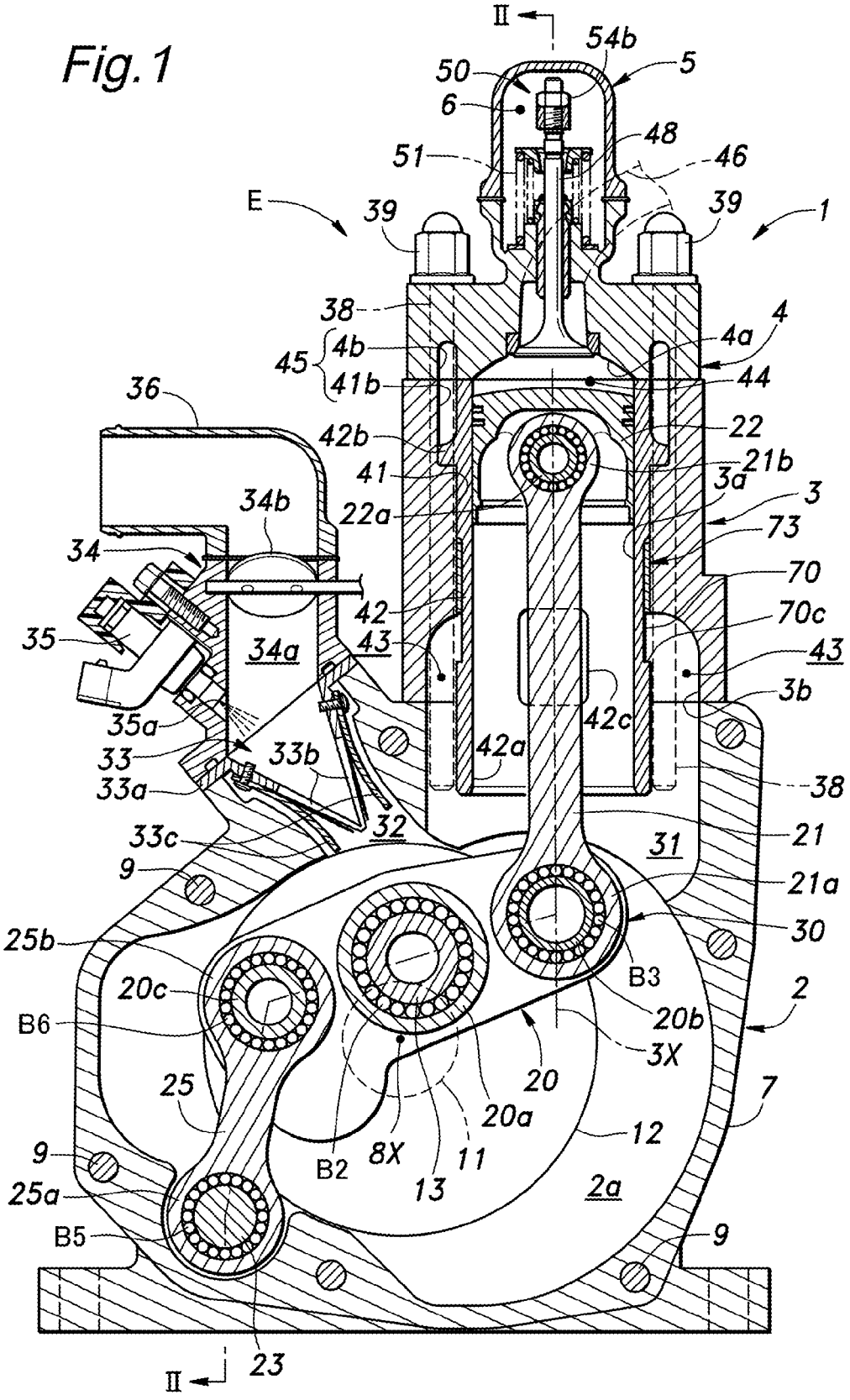
FIG. 1 is a vertical sectional view of an engine embodying the present invention (taken along line I-I of FIG. 2)
Figure 2:
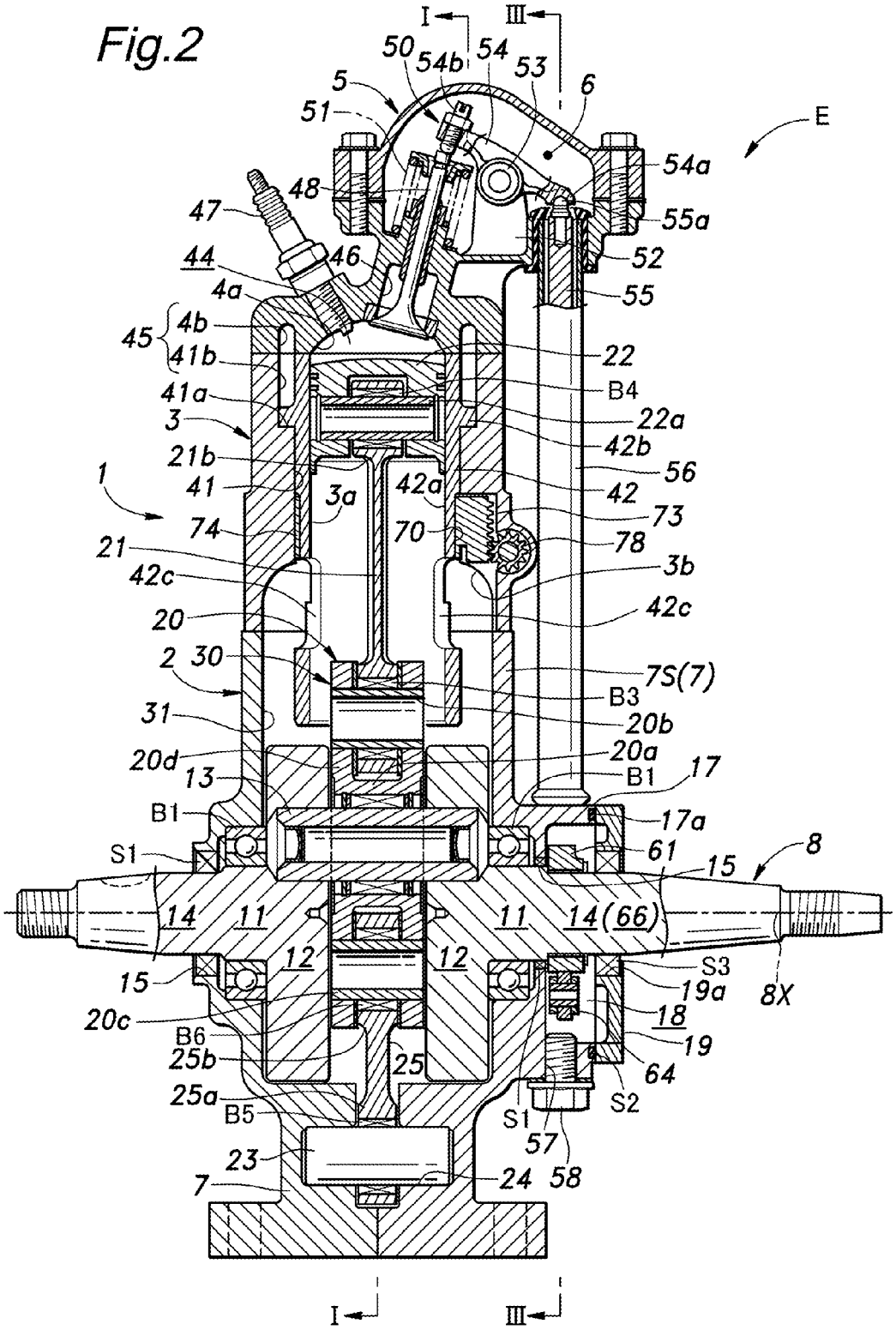
FIG. 2 is a sectional view taken along line II-II of FIG. 1.

Referring to FIGS. 1 and 2, an engine main body 1 of the engine E is provided with a crankcase 2 defining a crank chamber 2*a* therein, a cylinder block 3 connected to the upper end of the crankcase 2 and defining a cylinder bore 3*a* therein, a cylinder head 4 connected to the upper end of the cylinder block 3 and a head cover 5 attached to the upper end of the cylinder head 4 to define an upper valve chamber 6 in cooperation with the cylinder head 4.

Figure 3:
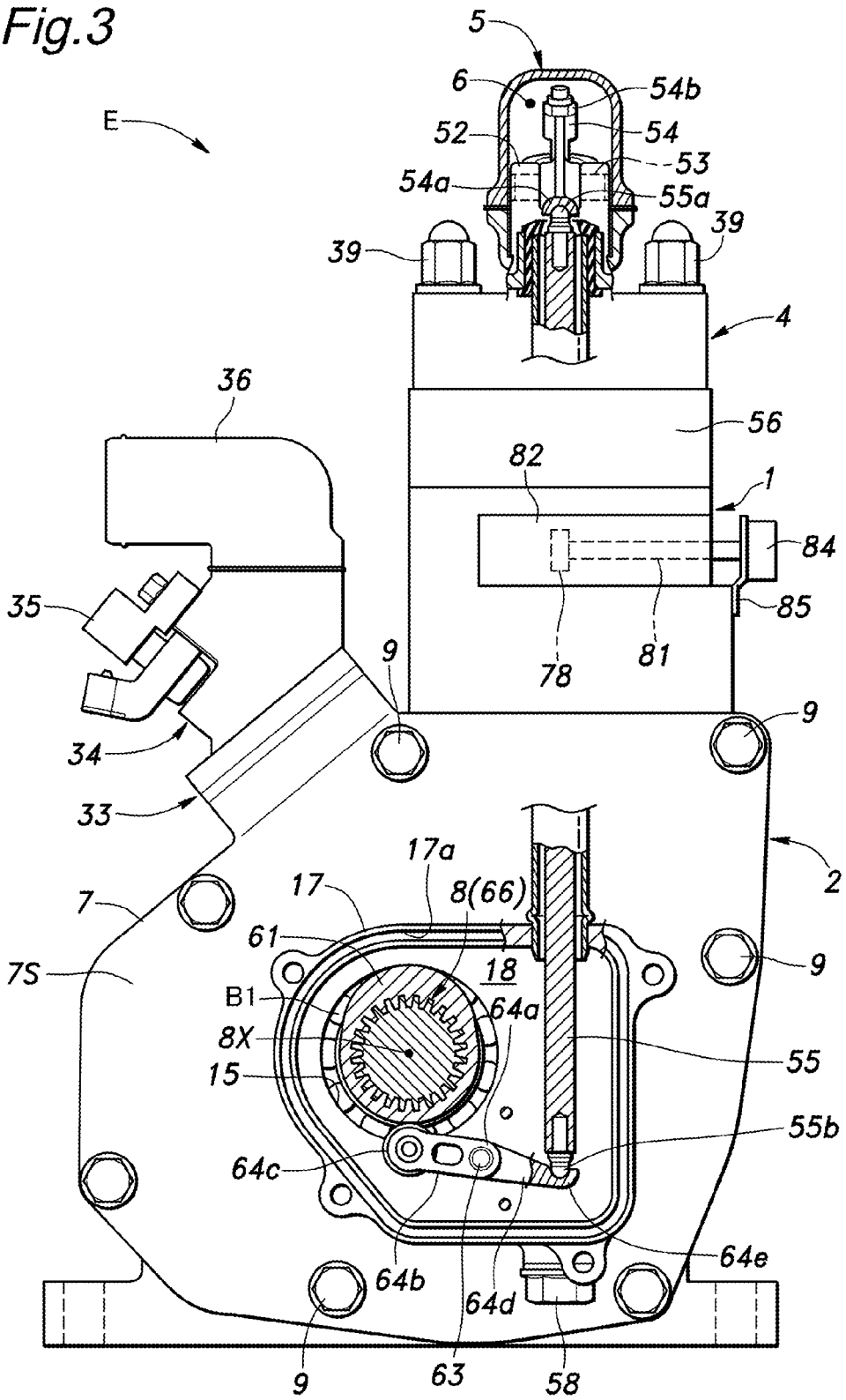
FIG. 3 is a sectional view taken along line III-III of FIG. 2.

As best shown in FIG. 2, the crankcase 2 consists of two crankcase halves 7 having a parting plane extending perpendicularly to the crankshaft axial line 8X and joined to each other by seven threaded bolts 9 (FIGS. 1 and 3). Each crankcase half 7 includes a side wall 7S which is provided with an opening through which the corresponding end of a crankshaft 8 projects, and the corresponding end of the crankshaft 8 is rotatably supported by the side wall 7S via a first bearing B1. Thus, the crankshaft 8 is rotatably supported at two ends thereof by the crankcase 2, and has a crank throw received in the crank chamber 2*a* defined by the crankcase 2.

The crankshaft 8 includes a pair of journals 11 that are rotatively supported by the first bearings B1, respectively, a pair of crank webs 12 extending radially from middle parts of the crankshaft 8, a crankpin 13 extending between the two webs 12 radially offset from and in parallel with the axial line 8X of the crankshaft 8, and a pair of extensions 14 extending coaxially from the outer ends of the journals 11 out of the crankcase 2. Each crank web 12 is formed as a circular disk defining a larger radius than the outer profile of the crankpin 13 so as to serve as a flywheel that stabilizes the rotation of the crankshaft 8 without substantially splashing the lubricating oil in the crank chamber 2*a*.

Each extension 14 of the crankshaft 8 extends out of the crankcase 2 via a through hole 15 formed in the side wall 7S of the corresponding crankcase half 7. The outer side of each ball bearing B1 is fitted with a seal S1 to ensure an air tight seal of the crank chamber 2*a*. As shown in FIGS. 2 and 3, the side wall 7S of the right crankcase half 7 is integrally formed with a lower valve case 17 protruding therefrom so as to surround the right extension 14 of the crankshaft 8 as seen in FIG. 2.

The lower valve case 17 is cylindrical in shape with an open outer axial end, and internally defines a lower valve chamber 18. The opening of the outer end of the lower valve case 17 is closed by a valve chamber lid 19. The outer axial end of the lower valve case 17 is provided with an annular seal groove 17*a* so that the valve chamber lid 19 may be joined to the opening of the lower valve case 17 in an air tight manner via a second seal member S2 received in the seal groove 17*a*.

The right end of the crankshaft 8 seen in FIG. 2 is passed through a through hole 19*a* formed in the valve chamber lid 19, and extends further outward. The inner circumference of the through hole 19*a* is provided with a third seal member S3 for ensuring the airtight condition of the lower valve case 17, and hence the airtight condition of the crank chamber 2*a*.

As shown in FIG. 1, the central axial line 8X of the crankshaft 8 or the axial center of the journals 11 is offset from the cylinder axial line 3X to a side (left side in FIG. 1). The crankpin 13 rotates around the central axial line 8X of the crankshaft 8 as the crankshaft 8 rotates, and rotatably supports a middle point of a trigonal link 20 via a tubular portion 20*a* of the trigonal link 20. A second bearing B2 is interposed between the crankpin 13 and the tubular portion 20*a*.

The trigonal link 20 includes a pair of plates 20*d* that are joined by the tubular portion 20*a* in a mutually parallel relationship, and a pair of connecting pins (a first connecting pin 20*b* and a second connecting pin 20*c*) fixedly passed between the two plates 20*d*. These connecting pins 20*b* and 20*c* and the crankpin 13 form three pivot points that are arranged in a line at a substantially same interval with the crankpin 13 located in the middle.

The first connecting pin 20*b* located on the side of the cylinder axial line 3X is pivotally connected to a big end 21*a* of a connecting rod 21 via a third bearing B3. A small end 21*b* of the connecting rod 21 is pivotally connected to a piston 22 slidably received in the cylinder bore 3*a* via a piston pin 22*a* and a fourth bearing B4.

A pivot shaft 23 is fixedly provided in a lower part of the crankcase 2, on the side remote from the first connecting pin 20*b*. The rotational center lines of the pivot shaft 23 and the three pivot points (20*a*, 20*b* and 20*c*) are all in parallel to one another. As shown in FIG. 2, the pivot shaft 23 is press fitted into a pair of mutually opposing holes 24 formed in the two halves of the crankcase 2, respectively. A base end 25*a* of a swing link 25 is pivotally connected to the pivot shaft 23 via a fifth bearing B5. The swing link 25 extends substantially upward from the base end 25*a* thereof, and an upper end or a free end 25*b* of the swing link 25 is pivotally supported by the second connecting pin 20*c* (remote from the cylinder axial line 3X) via a sixth bearing B6.

The engine E is thus provided with a multiple link mechanism 30 which includes the trigonal link 20 and the swing link 25 in addition to the connecting rod 21. The multiple link mechanism 30 converts the linear reciprocating movement of the piston 22 into a rotational movement of the crankshaft 8. The dimensions and positions of the various components of the multiple link mechanism 30 are selected and arranged such that a prescribed compression ratio selected for the properties of the particular fuel may be achieved. The compression ratio is selected such that the pre-mixed mixture may self-ignite in an appropriate manner. The fuels that may be used for this engine include gasoline, diesel fuel, kerosene, gas (utility gas, LP gas and so on), etc.

Owing to the use of the multiple link mechanism 30, for the given size of the engine E, the piston stroke L can be maximized so that a larger part of the thermal energy can be converted into kinetic energy, and the thermal efficiency of the engine E can be improved. More specifically, as shown in part (A) of FIG. 4, when the piston 22 is at the top dead center, the big end 21*a* of the connecting rod 21 which is connected to the first connecting pin 20*b* at the right end of the trigonal link 20 is located higher than the crankpin 13 by a first distance D1. Furthermore, as shown in part (B) of FIG. 4, when the piston 22 is at the bottom dead center, the big end 21*a* of the connecting rod 21 is located lower than the crankpin 13 by a second distance D2. Therefore, as compared to the conventional engine where the big end 21*a* of the connecting rod 21 is directly connected to the crankpin 13, the piston stroke L can be extended by the sum of these two distances or by D1+D2. Therefore, the piston stroke L of the engine E can be extended without increasing the size of the crankcase 2 or the overall height of the engine E.

Figure 4:
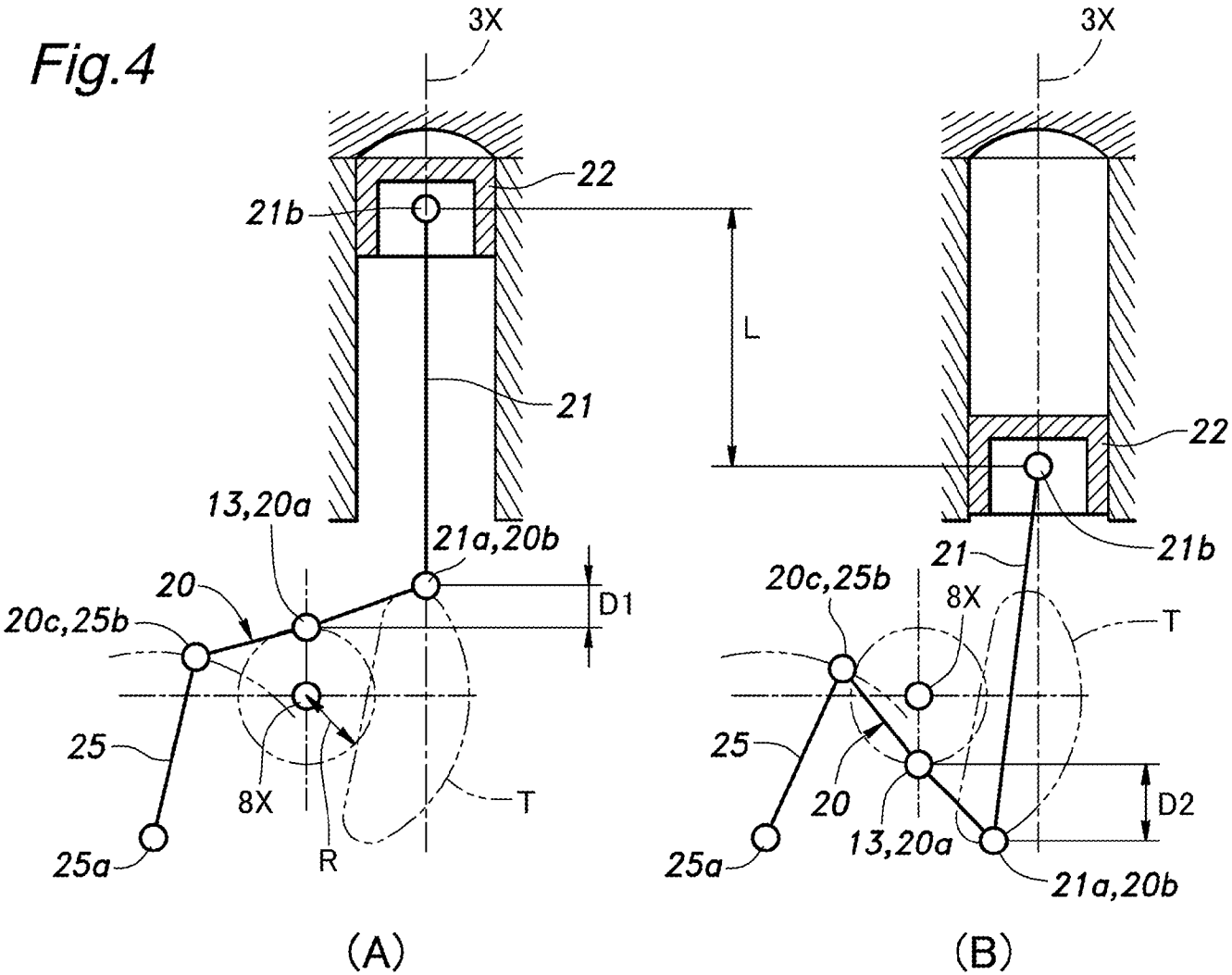
FIG. 4 is a diagram showing the mode of operation of a multiple linkage mechanism used in the engine.

In this engine E, the trajectory T of the big end 21*a* of the connecting rod 21 is vertically elongated, instead of being truly circular, as shown in (A) and (B) of FIG. 4. In other words, as compared to the more conventional reciprocating engine having the constant crank radius R, the swing angle of the connecting rod 21 is reduced. Therefore, the interferences between the lower end of the cylinder (or lower end of the cylinder sleeve 42) and the connecting rod 21 can be avoided even when the cylinder bore 3*a* is relatively small. Furthermore, the reduction in the swing angle of the connecting rod 21 contributes to the reduction in the thrust loads which the piston 22 applies to the two sides (thrust side and anti-thrust side) of the cylinder wall.

As shown in FIG. 1, the crank chamber 2*a* is laterally extended in the region of the swing link 25 and is vertically extended in the region directly under the piston 22 so that the trigonal link 20 that undergoes a composite rotational movement, the swing link 25 that undergoes a swinging movement and the connecting rod 21 that undergoes a vertically elongated circular movement may not interfere with one another. The part of the crankcase 2 adjoining the lower end of the cylinder bore 3*a* is formed with a cylindrical recess 31 having a circular cross section (taken along a horizontal plane) substantially coaxial with the cylinder bore 3*a* and surrounding the lower end of the cylinder sleeve 42 such that an annular space communicating with the crank chamber 2*a* is defined around the lower end of the cylinder sleeve 42.

An intake port 32 is formed by a tubular extension of the crankcase 2 extending obliquely upward adjacent to the cylindrical recess 31 in the upper part of the crankcase 2. The intake port 32 is fitted with a reed valve 33 that permits the flow of air from the intake port 32 to the crank chamber 2*a*, and prohibits the flow of air in the opposite direction. The reed valve 33 includes a base member 33*a* consisting of a wedge shaped member having a pointed end directed inward and a pair of openings defined on either slanted sides thereof, a pair of valve elements 33*b* mounted on the base member 33*a* so as to cooperate with the openings thereof and a pair of stoppers 33*c* placed on the backsides of the valve elements 33*b* so as to limit the opening movement of the valve elements 33*b* within a prescribed limit. The reed valve 33 is normally closed, and opens when the piston 22 moves upward and the internal pressure in the crank chamber 2*a* thereby drops.

To the outer end of the intake port 32 is connected a throttle body 34 so as to define an intake passage 34*a* extending vertically as a smooth continuation of the intake port 32. A throttle valve 34*b* is pivotally mounted on a horizontal shaft for selectively closing and opening the intake passage 34*a*. A fuel injector 35 is also mounted on the throttle body 34 with an injection nozzle 35*a* thereof directed into a part of the intake passage 34*a* somewhat downstream of the throttle valve 34*b*. The axial line of the fuel injector 35 is disposed obliquely so as to be directed to the reed valve 33, and fuel is injected into the intake passage 34*a* in synchronism with the opening of the reed valve 33. The upstream end of the throttle body 34 is connected to an L shaped intake pipe 36 including a vertical section connected to the throttle body 34 and a horizontal section extending away from the cylinder block 3.

Four stud bolts 38 are secured to the upper side of the crankcase 2 and extend upward around the cylinder bore 3*a* at a regular interval as can be seen from FIG. 1. The cylinder block 3 and the cylinder head 4 are secured to the crankcase 2 by passing the stud bolts 38 therethrough and threading acorn nuts 39 onto the upper ends of the stud bolts 38.

As shown in FIGS. 1 and 2, the cylinder block 3 is provided with a bore 41 having a circular cross section passed therethrough, and the cylinder sleeve 42 is fitted into this bore 41 with the lower end thereof extending into the cylindrical recess 31 mentioned above. The bore 41 is provided with a large diameter section in an upper end thereof defining an annular shoulder 41*a* facing upward, and the cylinder sleeve 42 is provided with a radial flange 42*b* configured to rest on this annular shoulder 41*a*. The upper end part of the cylinder sleeve 42 (or the part thereof located above the radial flange 42*b*) defines an annular space 41*b* in cooperation with the large diameter section of the bore 41 of the cylinder block 3.

The cylinder sleeve 42 is provided with a constant inner diameter over the entire length thereof except for the lower end thereof which is chamfered, and the cylinder bore 3*a* is defined by an inner circumferential surface 42*a* of the cylinder sleeve 42. The outer diameter of the cylinder sleeve 42 is also constant over the entire length thereof except for the lower end thereof which is reduced in diameter over a certain length and a part adjacent to the upper end thereof which is provided with the radial flange 42*b* defining an annular shoulder surface abutting the annular shoulder 41*a* to determine the axial position of the cylinder sleeve 42 relative to the cylinder block 3. The upper end of the cylinder sleeve 42 is flush with the upper end surface of the cylinder block 3, and the cylinder sleeve 42 is provided with a somewhat greater vertical dimension than the cylinder block 3 so that the lower end of the cylinder sleeve 42 projects out of the lower end of the cylinder block 3 into the cylindrical recess 31 of the crankcase 2.

Figure 5:
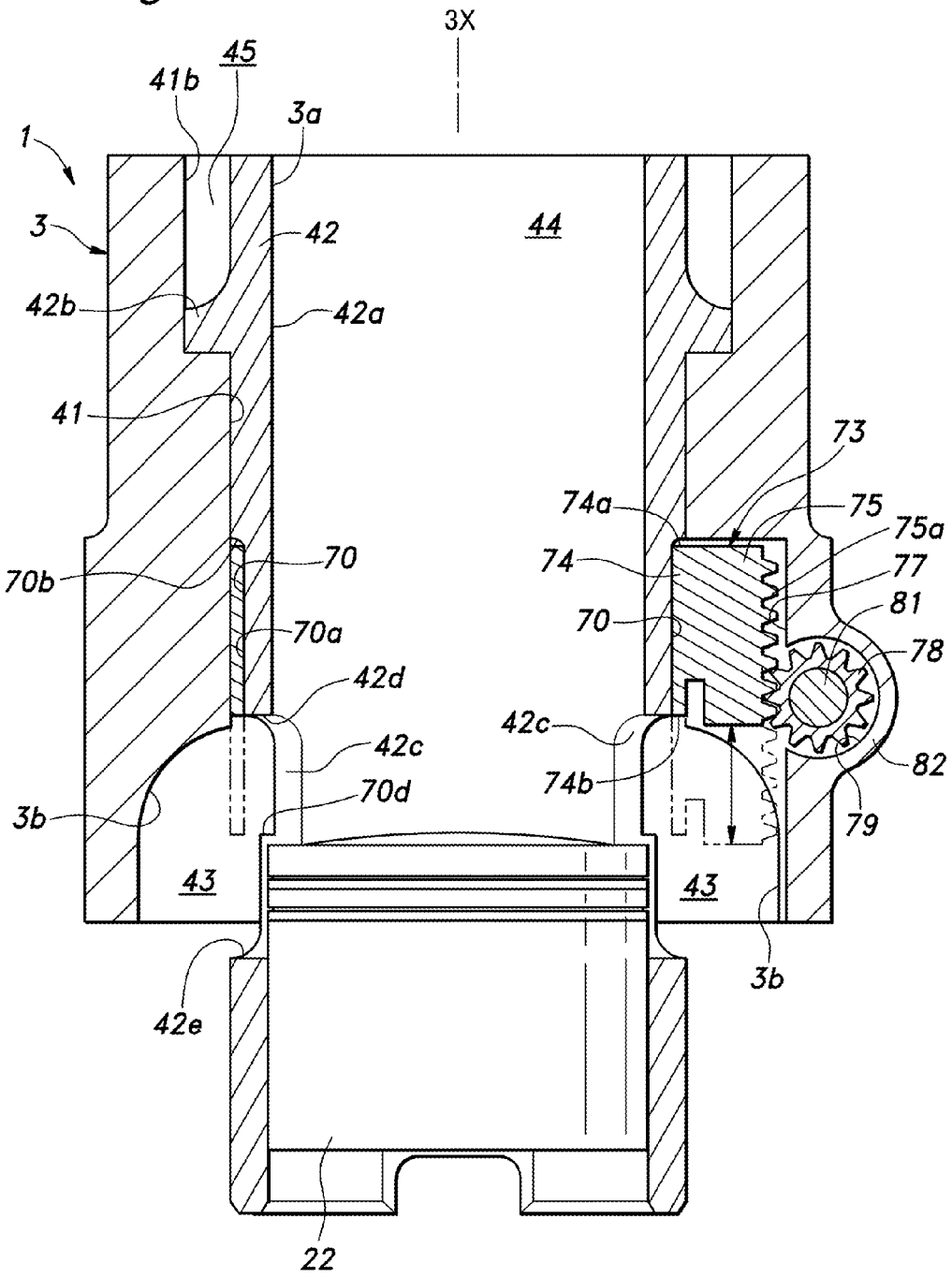
FIG. 5 is an enlarged fragmentary sectional view of a part of FIG. 2.

A pair of scavenging orifices 42*c* which are identically shaped and dimensioned are formed on either side of the cylinder sleeve 42, and arranged 180 degrees apart about the cylinder axial line 3X at a same elevation. As shown in FIG. 5, each scavenging orifice 42*c* is provided with an upper edge 42*d* located higher than the parting plane between the cylinder block 3 and the crankcase 2, and a lower edge 42*e* located lower than this parting plane. The upper end (compression ring) of the piston 22 is located higher than the upper edge 42*d* of the scavenging orifices 42*c* at least when the piston 22 is at the top dead center, and is located lower than the upper edge 42*d* of the scavenging orifices 42*c* when the piston 22 is at the bottom dead center. Preferably, the upper end of the piston 22 is located higher than the upper edge 42*d* of the scavenging orifices 42*c* when the piston 22 is at the top dead center, and is located lower than the lower edge 42*d* of the scavenging orifices 42*c* when the piston 22 is at the bottom dead center.

As shown in FIGS. 1, 2 and 5, an axially intermediate part of the cylinder sleeve 42 is formed with an annular recess 70 having a certain vertical width on the outer circumference thereof. The annular recess 70 is provided with a bottom surface 70*a* extending circumferentially concentric to the cylinder axial line 3X. The upper wall 70*b* and the lower wall 70*c* defining the upper and lower edge of the annular recess 70 extend substantially vertically with respect to the bottom surface 70*a* so that the vertical cross section of the annular recess 70 is substantially rectangular. In other words, the annular recess 70 continues with the remaining part of the outer circumferential surface of the cylinder sleeve 42 via the steps defined by the upper wall 70*b* and the lower wall 70*c*.

The upper wall 70*b* of the annular recess 70 is located higher than the upper edge 42*d* of the scavenging orifices 42*c*, and the lower wall 70*c* of the annular recess 70 is located intermediate between the upper edge 42*d* and the lower edge 42*e* of the scavenging orifices 42*c*. In other words, the scavenging orifices 42*c* straddle across the lower wall 70*c* of the annular recess 70 so that an upper half of each scavenging orifice 42*c* opens out at the bottom surface 70*a* of the annular recess 70 and the lower half of each scavenging orifice 42*c* opens out at the part of the outer circumferential surface of the cylinder sleeve 42 located below the annular recess 70.

As shown in FIGS. 1 and 2, the lower end part of the cylinder block 3 surrounding the cylinder sleeve 42 is formed with an annular recess 3*b* concentrically surrounding the cylinder axial line 3X. This annular recess 3*b* extends vertically (widthwise) such that the lower end thereof opens out at the lower surface of the cylinder block 3 and communicates with the cylindrical recess 31. The upper end of the annular recess 3*b* extends up to the upper edge 42*d* of the scavenging orifices 42*c*. Alternatively, the upper end of the annular recess 3*b* may extend slightly beyond the upper edge 42*d* of the scavenging orifices 42*c*.

The scavenging orifices 42*c*, the cylindrical recess 31 and the corresponding annular recess 3*b* jointly form a scavenging port 43 that communicates the crank chamber 2*a* and the cylinder bore 3*a* with each other. In particular, the scavenging orifices 42*c* defining the open end of the scavenging port 43 on the side of the cylinder bore 3*a*. The upper end of the annular recess 3*b* is defined by a curved wall surface curving toward the cylinder bore 42 as one moves upward so that the mixture flowing upward through the annular recess 3*b* may be smoothly guided to the scavenging orifices 42*c* on the side part of the cylinder bore 3*a*.

As shown in FIG. 5, a shutter 73 is fitted on the outer circumferential surface of the cylinder sleeve 42 so as to be moveable in the axial direction (along the cylinder axial line 3X). The shutter 73 includes a thin-walled tubular portion 74 and a rack 75 fixedly attached to the outer surface of the tubular portion 74 and extending in the axial direction. The rack 75 is provided with rack teeth 75*a* facing radially outward.

The tubular portion 74 of the shutter 73 is received in the annular recess 70 of the cylinder sleeve 42 in a coaxial relationship to the cylinder sleeve 42 (cylinder bore 3*a*). The inner circumferential surface of the tubular portion 74 is in close contact with the bottom surface 70*a* of the annular recess 70 in a mutually slidable manner. The axial length (width) of the tubular portion 74 is somewhat smaller than the distance between the upper wall 70*b* and the lower wall 70*c* (the width) of the annular recess 70 so that the tubular portion 74 is moveable along the cylinder axial line 3X within the annular recess 70. The upper and lower limits of this movement are defined by the upper wall 70*b* and the lower wall 70*c* of the annular recess 70, respectively. Therefore, the tubular portion 74 is moveable along the cylinder axial line 3X within the annular recess 70 within a prescribed range.

As shown in FIG. 5, the rack 75 is provided on one side of the tubular portion 74. The cylinder block 3 is formed with a recess 77 extending vertically from the annular recess 3*b* of the cylinder block 3 to accommodate the rack 75 therein over the entire vertical stroke of the shutter 73 and permit the vertical movement of the shutter 73 without interfering with the cylinder block 3. The side surfaces of the rack 75 may be in slidable engagement with the side walls of the recess 77 to restrict the rotation of the shutter 73 around the cylinder axial line 3X.

A pinion 78 is rotatably supported by the cylinder block 3 via a pinion shaft 81, and meshes with the rack teeth 75*a* of the rack 75. The cylinder block 3 is formed with a cavity 79 to receive the pinion 78 therein, and the cylinder block 3 is formed with a corresponding external bulge 82 to create the space for the pinion 78 without increasing the overall size of the cylinder block 3. As shown in FIG. 3, the pinion shaft 81 extends perpendicularly to both the crank axial line 8X and the cylinder axial line 3X, and has an outer end extending out of the cylinder block 3 and connected to the output shaft of an electric motor 84. The electric motor 84 is fixedly attached to the outer surface of the cylinder block 3 via a bracket 85. Therefore, when the electric motor 84 is activated, the pinion 78 rotates, and the tubular portion 74 of the shutter 73 moves along the cylinder axial line 3X owing to the meshing between the pinion 78 and the rack teeth 75*a* of the rack 75. The electric motor 84 is controlled by an electronic control unit (ECU) not shown in the drawings according to the operating condition of the engine.

In FIG. 5, the upper most position of the shutter 73 is indicated by solid lines, and the lower most position of the shutter 73 is indicated by double-dot chain-dot lines. At the upper most position, the lower edge 74*b* of the tubular portion 74 coincides with the upper edge 42*d* of the scavenging orifices 42*c*. At the lower most position, the lower edge 74*b* of the tubular portion 74 opposes a lower part of the scavenging orifices 42*c*.

Therefore, when the shutter 73 moves downward along the cylinder axial line 3X from the upper most position, the lower edge 74*b* of the tubular portion 74 passes the upper edge 42*d* of the scavenging orifices 42*c*, and projects into the scavenging orifices 42*c* so as to define a new upper edge of the opening of the scavenging port 43 at the cylinder bore, this new opening being narrower than that defined by the scavenging orifices 42*c*. In other words, when the position of the shutter 73 is changed along the cylinder axial line 3X, the timing of starting the communication between the scavenging port 43 and the combustion chamber 44 (the part of the cylinder bore 3*a* defined above the piston 22) or the opening timing of the scavenging port 43 during the downward stroke of the piston 22, and the timing of ending the communication between the scavenging port 43 and the combustion chamber 44 (the part of the cylinder bore 3*a* defined above the piston 22) or the closing timing of the scavenging port 43 during the upward stroke of the piston 22 can be changed. By changing the opening timing and the closing timing of the scavenging port 43, the duration of the open state of the scavenging port 43 or the open period can be changed.

As shown in FIGS. 1 and 2, the part of the lower surface of the cylinder head 4 corresponding to the cylinder bore 3*a* is recessed in a dome-shape (dome-shaped recess 4*a*) so as to define a combustion chamber 44 jointly with the top surface of the piston 22. An annular groove 4*b* is formed in the lower surface of the cylinder head 4 concentrically around the dome-shaped recess 4*a* which aligns with the annular recess 41*b* defined between the upper part of the cylinder sleeve 42 and the surrounding wall of the cylinder block 3 such that a water jacket 45 surrounding the dome-shaped space 4*a* of the cylinder head 4 and the upper part of the cylinder bore 3*a* is defined jointly by the annular space 41*b* and the annular groove 4*b*.

The cylinder head 4 is further provided with an exhaust port 46 opening out at the top end of the combustion chamber 44 and a plug hole for receiving a spark plug 47 therein. In the illustrated embodiment, the spark plug 47 is normally activated only at the time of starting the engine to ignite the mixture in the combustion chamber 44. The exhaust port 46 is provided with an exhaust valve 48 consisting of a poppet valve to selectively close and open the exhaust port 46. The exhaust valve 48 includes a valve stem which is slidably guided by the cylinder head 4 at an angle to the cylinder axial line 3X, and the stem end of the exhaust valve 48 extends into the upper valve chamber 6 containing a part of the valve actuating mechanism 50 for actuating the exhaust valve 48 via the stem end thereof.

The valve actuating mechanism 50 includes a valve spring 51 that resiliently urges the exhaust valve 48 in the closing direction (upward), an upper rocker shaft 53 supported by a block 52 provided on the cylinder head 4 and an upper rocker arm 54 rotatably supported by the upper rocker shaft 53. The upper rocker shaft 53 extends substantially perpendicularly to the crankshaft 8, and the upper rocker arm 54 extends substantially in parallel to the crankshaft 8. One end of the upper rocker arm 54 is provided with a socket 54*a* engaging the upper end 55*a* of the pushrod 55, and the other end of the upper rocker arm 54 is provided with a tappet adjuster 54*b* consisting of the screw which engages the stem end of the exhaust valve 48. The upper end 55*a* of the pushrod 55 is given with a semi-spherical shape, and the socket 54*a* of the rocker arm 54 receives the upper end 55*a* of the pushrod 55 in a complementary manner, allowing a certain sliding movement between them.

As shown in FIGS. 2 and 3, the pushrod 55 extends substantially vertically along a side of the cylinder block 3, and is received in a tubular rod case 56 having an upper end connected to the cylinder head 4 and a lower end connected to the lower valve case 17. In the illustrated embodiment, the rod case 56 extends along the exterior of the cylinder block 3.

Because the crankshaft 8 is offset from the cylinder axial line 3X (FIG. 1), as best shown in FIG. 3, the lower end of the rod case 56 is connected to a part of the upper wall of the lower valve case 17 laterally offset from the crankshaft 8. The lower valve chamber 18 receives the remaining part of the valve actuating mechanism 50. The lower wall of the lower valve case 17 is provided with a drain hole 57 for expelling the lubricating oil in the lower valve chamber 18 which is usually closed by a drain plug 58.

The valve actuating mechanism 50 further comprises a cam 61 carried by the part of the crankshaft 8 extending into the lower valve chamber 18, a lower rocker shaft 63 supported by the side wall 7S of the crankcase 2 and the valve chamber lid 19 in parallel with the crankshaft 8 and a lower rocker arm 64 pivotally supported by the lower rocker shaft 63 for cooperation with the cam 61. In other words, one of the extensions 14 of the crankshaft 8 (the right end thereof in FIG. 2) serves as the camshaft 66 for the cam 61.

As shown in FIG. 3, the lower rocker arm 64 includes a tubular portion 64*a* rotatably supported by the lower rocker shaft 63, a first arm 64*b* extending from the tubular portion 64*a* toward the crankshaft 8, a roller 64*c* pivotally supported by the free end of the first arm 64*b* to make a rolling contact with the cam 61, a second arm 64*d* extending from the tubular portion 64*a* away from the first arm 64*b*, and a receiving portion 64*e* formed in the free end of the second arm 64*d* to support the lower end 55*b* of the pushrod 55. The lower end of the pushrod 55 is given with a semi-spherical shape, and the receiving portion 64*e* is formed as a recess complementary to the semi-spherical lower end of the pushrod 55 so as to receive the lower end of the pushrod 55 in a mutually slidable manner.

The engine E described above operates as described in the following at the time of start-up. Referring to FIG. 1, in the upward stroke of the piston 22, owing to the depressurization of the crank chamber 2*a*, the reed valve 33 opens. As a result, a mixture of the fresh air metered by the throttle valve 34*b* and the fuel injected into this fresh air by the fuel injector 35 is drawn into the crank chamber 2*a* via the reed valve 33 and the intake port 32. Meanwhile, the mixture in the cylinder bore 3*a* is compressed by the piston 22, and is ignited by the spark from the spark plug 47 when the piston 22 is near the top dead center.

The piston 22 then undergoes a downward stroke, and because the reed valve 33 is closed at this time, the mixture in the crank chamber 2*a* is prevented from flowing back to the throttle valve 34*b*, and compressed. During the downward stroke of the piston 22, before the piston 22 opens the scavenging port 43, the exhaust valve 48 actuated by the valve actuating mechanism 50 according to the cam profile of the cam 61 opens the exhaust port 46. Once the piston 22 opens the scavenging port 43, the compressed mixture is introduced into the cylinder bore 3*a* (combustion chamber 44) via the scavenging port 43. The combustion gas in the combustion chamber 44 is displaced by this mixture, and is expelled from the exhaust port 46 while part of the combustion gas remains in the combustion chamber 44 as EGR gas. The valve opening timing of the exhaust valve 48 is determined such that the amount of the EGR gas remaining in the combustion chamber 44 is great enough for the self-ignition of the mixture to take place owing to the rise in the temperature of the mixture in the combustion chamber 44 under compression with the increase in the amount of the EGR gas.

When the piston 22 undergoes an upward stroke once again, the piston 22 closes the scavenging port 43, and, thereafter, the exhaust valve 48 actuated by the first cam 61 closes the exhaust port 46. As a result, the mixture in the cylinder bore 3*a* (combustion chamber 44) is compressed while the crank chamber 2*a* is depressurized, causing the mixture to be drawn thereinto via the reed valve 33. Once the engine E is brought into a stable operation, the mixture is self-ignited as the piston 22 comes near the top dead center, and the combustion gas created by the resulting combustion pushes down the piston 22.

The engine E thus performs a two-stroke operation. In particular, spark ignition using the spark plug 47 is required at the time of start up, but once the engine starts operating in a stable manner, a two-stroke operation based on a homogeneous charge compression ignition is performed. The scavenging flow from the scavenging port 43 to the exhaust port 46 via the cylinder bore 3*a* is guided along a relatively straight path, or the so-called "uni-flow scavenging" can be achieved.

The engine E described above allows the opening timing, the closing timing and the open period of the scavenging port 43 to be adjusted owing to the provision of the shutter 73. As the lower edge 74*b* of the tubular portion 74 of the shutter 73 defines the upper edge of the open end of the scavenging port 43 on the side of the cylinder bore 3*a*, the displacement of the shutter 73 along the cylinder axial line 3X changes the timing of the upper end of the piston 22 passing the lower edge 74*b* of the tubular portion 74, and hence the open timing and the closing timing of the scavenging port 43. A certain gap corresponding to the thickness of the cylinder sleeve 42 is created between the outer circumferential surface of the piston 22 and the inner circumferential surface of the tubular portion 74, but the cross sectional area of the this gap is so small as compared to the cross sectional area of the scavenging port 43 that the effect of this gap on the communication state between the combustion chamber 44 and the scavenging port 43 is not significant.

By changing the opening timing, the closing timing and the open period of the scavenging port 43, the amount of the mixture that is delivered to the combustion chamber 44 from the scavenging port 43 and the amount of the internal EGR that remains in the combustion chamber 44 can be adjusted. For instance, when the opening timing is delayed while the closing timing is advanced, thereby decreasing the opening period, the supply of the mixture into the combustion chamber 44 can be reduced, and the amount of the internal EGR can be increased. The position control for the shutter 73 in changing the opening timing, the closing timing and the open period of the scavenging port 43 can be performed in a continuous manner depending on the load condition and other operating conditions of the engine which may be determined by the engine rotational speed and the depression of the accelerator pedal.

The tubular portion 74 of the shutter 73 is coaxial with the cylinder bore 3*a* and the cylinder sleeve 42, and is moveable with respect to the cylinder bore 3*a* in the direction of the cylinder axial line 3X. Therefore, even when there are a plurality of scavenging orifices 42*c* around the cylinder bore 3*a*, the single shutter 73 can open and close all of the scavenging orifices 42*c*. The shutter 73 is subjected to radial loadings from the mixture that passes through the scavenging orifices 42*c* and the mixture compressed in the cylinder bore 3*a*, but because the tubular portion 74 is annular and surrounds the outer circumferential surface of the cylinder sleeve 42, the shutter 73 is prevented from deflecting in any direction, and can open and close the scavenging orifices 42*c* in a favorable and stable manner.

Because the tubular portion 74 of the shutter 73 is received in the annular recess 70 formed in the outer circumferential surface of the cylinder sleeve 42, the upper limit and the lower limit of the movement of the shutter 73 along the cylinder axial line 3X can be defined without requiring any special stopper members or stopper features.

Figure 6:
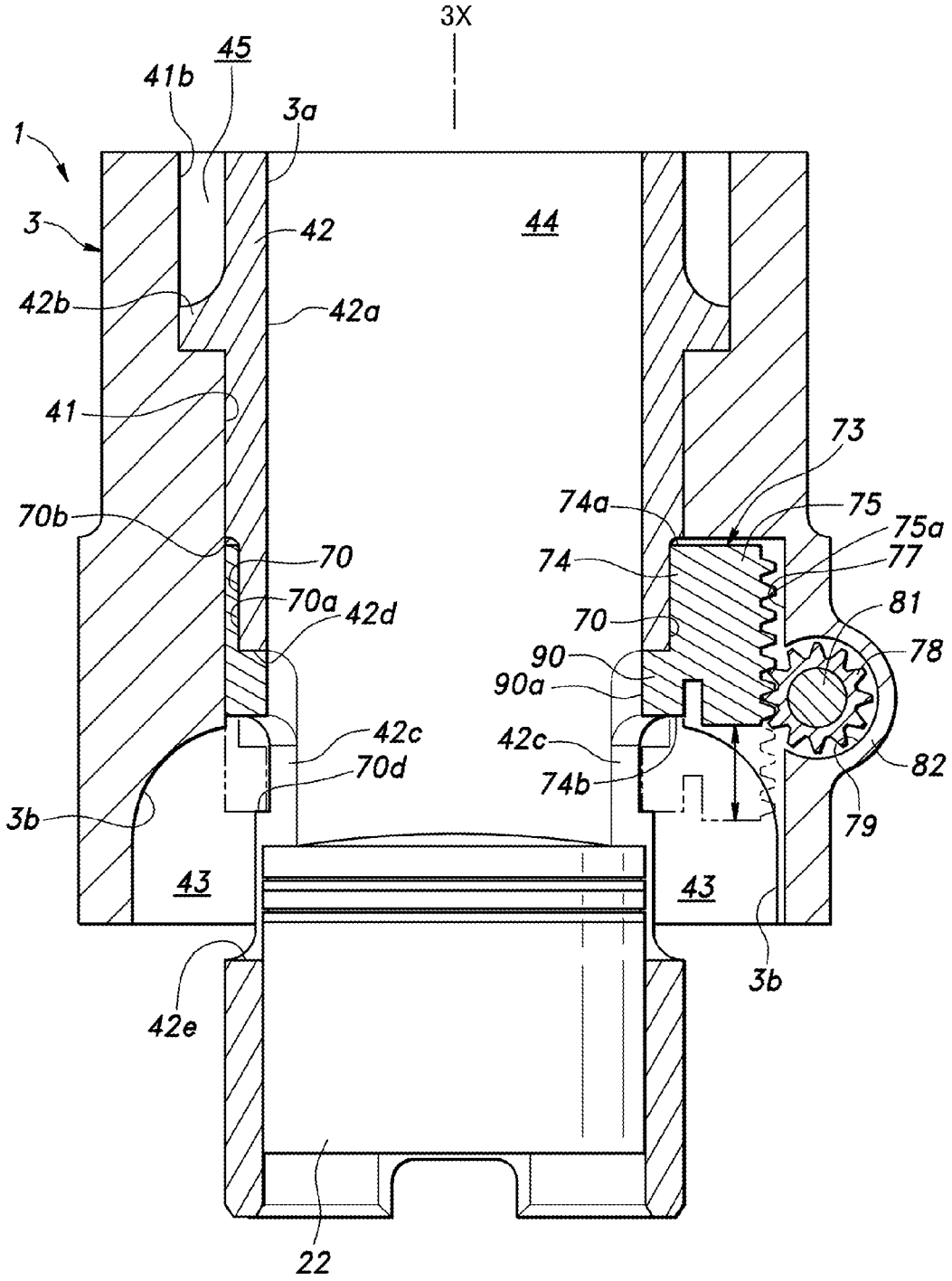
FIG. 6 is a view similar to FIG. 5 showing a second embodiment of the present invention.

A second embodiment of the present invention is described in the following with reference to FIG. 6. In the following description, the parts corresponding to those of the previous embodiment are denoted with like numerals without necessarily repeating the description of such parts. In this embodiment, when the shutter 73 is at the upper most position thereof, the lower edge 74*b* of the tubular portion 74 is located below the upper edge 42*d* of the scavenging orifices 42*c*. In other words, the lower edge 74*b* of the tubular portion 74 is always located below the upper edge 42*d* of the scavenging orifices 42*c*, and defines the upper edge of the scavenging port 43 at the open end thereof on the side of the cylinder bore 3*a*.

The part of the tubular portion 74 corresponding to each scavenging orifice 42*c* is provided with a thick-walled portion defining a projection 90 projecting into the scavenging orifice 42*c*, and the inner surface 90*a* of the projection 90 defines an inner circumferential surface continuous with the inner circumferential surface of the cylinder sleeve 42. In other words, the projection 90 defines a part of the cylinder wall surface defining the cylinder bore 3*a* such that the oil ring and the compression ring fitted in the outer circumference of the piston 22 slides along the inner surface 90*a* of the projection 90.

According to the second embodiment of the present invention, even when the wall thickness of the cylinder sleeve 42 is significant, no radial gap is created between the shutter 73 (tubular portion 74) and the piston 22. Therefore, when the upper end of the piston 22 is located below the upper edge 42*d* of the scavenging orifices 42*c*, and above the lower edge 74*b* of the tubular portion 74, communication between the combustion chamber 44 and the scavenging port 43 can be shut substantially completely.

Although the present invention has been described in terms of preferred embodiments thereof, it is obvious to a person skilled in the art that various alterations and modifications are possible without departing from the scope of the present invention. For instance, the shutter 73 included the tubular portion 74 for closing the scavenging orifices 42*c* in the foregoing embodiments, but may also consist of a plurality of plate members that are provided so as to correspond to the individual scavenging orifices 42*c*.

A rack and pinion mechanism consisting of the rack 75 and the pinion 78 was used for moving the shutter 73 along the cylinder axial line 3X in the foregoing embodiment, but any other per se known arrangement such as those using electromagnetic force can also be used.

The tubular portion 74 of the shutter 73 was received in the annular recess 70 so that the upper and lower limits of the axial movement of the shutter 73 may be limited by the upper and lower walls of the annular recess 70 in the foregoing embodiments, but it is also possible to eliminate the lower wall 70*c* (or have the bottom surface 70*a* to extend to the lower edge of the cylinder sleeve 42). This simplifies the assembling of the tubular portion 74 into the annular recess 70.

The contents of the original Japanese patent application on which the Paris Convention priority claim is made for the present application as well as the contents of the prior art references mentioned in this application are incorporated in this application by reference.

The invention claimed is:

1. A two-stroke engine including a piston slidably received in a cylinder bore defined in a cylinder block, a combustion chamber being defined by the cylinder bore and the piston, comprising:

a scavenging port having an open end opening out at a part of a cylinder wall defining a side of the cylinder bore, the open end communicating with the combustion chamber when the piston is near a bottom dead center thereof; and a shutter provided on the cylinder wall so as to selectively project into the open end from an upper edge thereof by moving along an axial line of the cylinder bore, wherein the shutter comprises a tubular portion disposed so as to be axially moveable in a coaxial relationship with the cylinder bore, the cylinder bore is defined by a cylinder sleeve, and the open end of the scavenging port comprises a scavenging orifice passed across a thickness of the cylinder sleeve, the tubular portion being wrapped around the cylinder sleeve in an axially slidable manner, and the tubular portion includes a projection received in the scavenging orifice and defining the cylinder bore jointly with the inner circumferential surface of the cylinder sleeve.

2. The two-stroke engine as defined in claim 1, wherein a part of the cylinder block surrounding the scavenging port is provided with a recess defining a passage leading to the scavenging orifice.

3. The two-stroke engine as defined in claim 2, wherein an annular recess is formed on a part of an outer circumferential surface of the cylinder sleeve provided with the scavenging orifice, and the tubular portion closely surrounds a bottom surface of the annular recess in an axially slidable manner.

4. The two-stroke engine as defined in claim 1, wherein the shutter further includes a rack extending axially on an outer surface of the tubular portion, and a pinion rotatably supported by the cylinder block and meshing with the rack.

* * * * *